US009746234B2

(12) United States Patent
Byfield et al.

(10) Patent No.: US 9,746,234 B2
(45) Date of Patent: Aug. 29, 2017

(54) MIXED REFRIGERANT COMPRESSION CIRCUIT

(75) Inventors: Geoffrey Brian Byfield, Nedlands (AU); Prabhu Pandalaneni, High Wycombe (AU)

(73) Assignee: Woodside Energy LTD, Perth (AU)

( * ) Notice: Subject to any disclaimer, the term of this patent is extended or adjusted under 35 U.S.C. 154(b) by 567 days.

(21) Appl. No.: 13/049,608

(22) Filed: Mar. 16, 2011

(65) Prior Publication Data

US 2012/0067080 A1 Mar. 22, 2012

Related U.S. Application Data

(63) Continuation of application No. PCT/AU2009/001041, filed on Aug. 13, 2009.

(30) Foreign Application Priority Data

Sep. 19, 2008 (AU) ..... 2008904872

(51) Int. Cl.
*F25J 1/00* (2006.01)
*F25J 1/02* (2006.01)
(Continued)

(52) U.S. Cl.
CPC ..... *F25J 1/0294* (2013.01); *F25B 1/10* (2013.01); *F25B 5/00* (2013.01); *F25B 5/02* (2013.01);
(Continued)

(58) Field of Classification Search
CPC ..... F25B 1/10; F25B 5/00; F25B 5/02; F25B 5/04; F25B 2400/06; F25B 2400/75;
(Continued)

(56) References Cited

U.S. PATENT DOCUMENTS 3,527,059 A 9/1970 Rust et al.
4,184,341 A 1/1980 Friedman
(Continued)

FOREIGN PATENT DOCUMENTS

EP 1860389 A1 11/2007
WO 9733131 A1 9/1997
(Continued)

OTHER PUBLICATIONS

International Search Report for PCT/AU2009/001477.
International Search Report for PCT/AU2009/001041.

*Primary Examiner* — Keith Raymond
(74) *Attorney, Agent, or Firm* — Edell, Shapiro & Finnan, LLC

(57) ABSTRACT

A refrigerant circuit includes a first compression stage for compressing a mixed refrigerant gas, the first compression stage including at least a first compressor body and a second parallel compressor body, each compressor body including a suction inlet and an outlet, a first distribution means for splitting the flow of refrigerant gas to the first stage of compression across the at least two parallel compressor bodies, such that a first stream of refrigerant gas is fed to the suction inlet of the first compressor body and a second stream of refrigerant gas is fed to the suction inlet of the second compressor body, a second compression stage for compressing the mixed refrigerant gas, and a first merging means for recombining the first stream of refrigerant gas with the second stream of refrigerant gas downstream of the first compression stage for delivery to the second compression stage.

18 Claims, 9 Drawing Sheets

(51) Int. Cl.

| | |
|---|---|
| ***F25B 5/02*** | (2006.01) |
| ***F25B 5/04*** | (2006.01) |
| ***F25B 5/00*** | (2006.01) |
| ***F25B 1/10*** | (2006.01) |

(52) U.S. Cl.

CPC ..... *F25B 5/04* (2013.01); *F25J 1/0022* (2013.01); *F25J 1/0052* (2013.01); *F25J 1/0087* (2013.01); *F25J 1/029* (2013.01); *F25J 1/0214* (2013.01); *F25J 1/0215* (2013.01); *F25J 1/0216* (2013.01); *F25J 1/0279* (2013.01); *F25J 1/0282* (2013.01); *F25J 1/0283* (2013.01); *F25J 1/0285* (2013.01); *F25J 1/0292* (2013.01); *F25B 2400/06* (2013.01); *F25B 2400/075* (2013.01); *F25J 2230/20* (2013.01); *F25J 2230/22* (2013.01); *F25J 2230/24* (2013.01); *F25J 2270/12* (2013.01); *F25J 2290/50* (2013.01)

(58) Field of Classification Search

CPC ..... F25J 1/0212–1/0218; F25J 1/0279; F25J 1/0294; F25J 2270/12; F25J 2290/50; F25J 2230/20; F25J 2230/22; F25J 2230/24; F25J 2400/06; F25J 2400/075

USPC ..... 62/612, 613

See application file for complete search history.

(56) References Cited

U.S. PATENT DOCUMENTS

| | | | | | |
|---|---|---|---|---|---|
| 4,594,858 | A * | 6/1986 | Shaw | 62/175 |
| 4,698,080 | A | 10/1987 | Gray et al. | |
| 4,755,200 | A | 7/1988 | Liu et al. | |
| 5,611,216 | A | 3/1997 | Low et al. | |
| 5,685,168 | A | 11/1997 | Sada | |
| 5,689,141 | A | 11/1997 | Kikkawa et al. | |
| 5,768,901 | A * | 6/1998 | Dormer et al. | 62/175 |
| 5,832,745 | A | 11/1998 | Nagelvoort et al. | |
| 5,857,348 | A | 1/1999 | Conry | |
| 6,041,619 | A | 3/2000 | Fischer et al. | |
| 6,324,867 | B1 | 12/2001 | Fanning et al. | |
| 6,334,334 | B1 | 1/2002 | Stockmann et al. | |
| 6,370,910 | B1 | 4/2002 | Grootjans et al. | |
| 6,389,844 | B1 | 5/2002 | Nagel Voort | |
| 6,637,238 | B2 | 10/2003 | Grootjans | |
| 6,658,891 | B2 | 12/2003 | Reijnen et al. | |
| 6,691,531 | B1 | 2/2004 | Martinez et al. | |
| 6,962,060 | B2 * | 11/2005 | Petrowski et al. | 62/612 |
| 7,219,512 | B1 | 5/2007 | Wilding et al. | |
| 8,561,425 | B2 * | 10/2013 | Mitra | F25B 1/10 62/115 |
| 2002/0170312 | A1 * | 11/2002 | Reijnen et al. | 62/611 |
| 2004/0020221 | A1 | 2/2004 | Flynn | |
| 2004/0255617 | A1 | 12/2004 | Paradowski | |
| 2006/0218965 | A1 * | 10/2006 | Manole | F25B 40/00 62/513 |
| 2009/0314030 | A1 * | 12/2009 | Jager | F25J 1/0218 62/612 |
| 2010/0132405 | A1 * | 6/2010 | Nilsen | 62/611 |
| 2010/0293997 | A1 * | 11/2010 | Chantant et al. | 62/614 |
| 2011/0113825 | A1 * | 5/2011 | Neeraas et al. | 62/613 |
| 2013/0129528 | A1 * | 5/2013 | Mirsky et al. | 417/53 |

FOREIGN PATENT DOCUMENTS

| | | | |
|---|---|---|---|
| WO | WO 97/33131 | * | 9/1997 |
| WO | 0144734 | A2 | 6/2001 |
| WO | WO 2008/095713 | * | 2/2007 |

* cited by examiner

MIXED REFRIGERANT COMPRESSION CIRCUIT

CROSS REFERENCE TO RELATED APPLICATIONS

This application is a continuation of PCT/AU2009/001041, filed on Aug. 13, 2009, which claims priority from Australian Patent Application No. AU 2008904872, filed on Sep. 19, 2008, the disclosures of which are incorporated herein by reference in their entireties.

TECHNICAL FIELD

The present invention is directed to a refrigerant compression circuit for use in the liquefaction of natural gas or other methane-rich gas streams. The invention is more specifically directed to a mixed component refrigerant compression circuit.

BACKGROUND

The cryogenic liquefaction of natural gas is routinely practiced as a means of converting natural gas into a more convenient form for transportation and storage. Liquefaction of large volumes of gas using a refrigerant circuit is energy and capital intensive. Broadly speaking, a plant for liquefying natural gas comprises a main heat exchanger in which a hydrocarbon gas feed stream is liquefied by means of indirect heat exchange with evaporating refrigerant in one or more stages. The plant further comprises a refrigerant circuit in which evaporated refrigerant(s) are compressed, cooled and returned to the main heat exchanger. The refrigerant circuit typically includes a compressor train consisting of at least one compressor body driven by means of a mechanical driver (e.g., a gas turbine, a steam turbine, or an electric motor) that is connected to the shaft of the compressor body via a common shaft or via a gearbox. The configuration of compressors and mechanical drivers in a gas processing plant greatly influences the energy efficiency of the plant.

New gas liquefaction and other gas processing plants are being designed for ever-increasing production rates in order to realize the favourable economic benefits associated with larger plants. These larger plants have larger refrigeration duties with higher refrigerant circulation rates, and therefore larger refrigerant compressors are required. The amount of natural gas which can be cooled per unit of time in the refrigerator is proportional to the volumetric flow rate of the refrigerant through the refrigerator. However, there is a practical upper limit to the volumetric flow rate which can be handled by a single large compressor with the result that the maximum achievable production rate is being limited by the maximum available compressor sizes.

At the present time, the largest available single compressor bodies suitable for mixed refrigerant service are limited to suction volumetric flows of about 250,000 $m^3$/hr. This limit has contributed to LNG train capacities remaining below 5.5 million tonnes per annum. In order to overcome this limitation, several approaches have been employed or proposed. One approach has been to increase the number of separate refrigerant cycles from two to three. Another approach is to duplicate the entire mixed refrigerant compression system using two complete parallel compression strings, with each string being arranged on a separate shaft using its own driver system. Using this approach, the entire mixed refrigerant compression flow is shared between the two parallel compression strings in order to overcome the limitation imposed by the maximum volumetric flow rate which can be handled by a single compressor body. The parallel string concept can be done in two different ways. One way is to duplicate the compressors only, then mix the flow through the other equipment and split the flow before it passes through the compressors. The other way is to have two unconnected (but identical) mixed refrigerant circuits, having two cooling systems and two main exchangers as well as two compressors. The use of parallel strings may be preferred to a system with a third separate refrigerant cycle, since if one of the parallel strings is shut down, the refrigeration cycle can continue to operate at a reduced capacity using the remaining string, thus maximising the availability of the plant in the event of a compressor outage. However, the duplication inherent in the use of parallel strings may increase the capital cost of a gas processing plant.

Other prior art refrigerant compression circuits are described in International patent publication number WO 01/44734; U.S. Pat. No. 3,527,059; U.S. Pat. No. 6,691,531; U.S. Pat. No. 6,637,238; U.S. Pat. No. 6,691,531; and, U.S. Pat. No. 6,962,060.

There exists a continuing need in the gas processing field to provide alternative plants and methods to eliminate the limitations on the size and volumetric flow of single large compressors without the use of parallel strings for all stages of compression. The present invention overcomes or ameliorates at least one of the aforementioned drawbacks of the prior art to provide an alternative method for the design of a refrigerant compression circuit for a hydrocarbon liquefaction plants.

SUMMARY

According to one aspect of the present invention there is provided a refrigerant circuit for use in a liquefaction plant, the refrigerant circuit comprising:

- a first compression stage for compressing a mixed refrigerant gas from a first pressure to a second pressure, the first compression stage comprising at least a first compressor body and a second parallel compressor body, each compressor body having a suction inlet and an outlet;
- a first distribution means for splitting the mass flow of refrigerant gas to the first stage of compression across the at least two parallel compressor bodies, such that a first stream of refrigerant gas is fed to the suction inlet of the first compressor body and a second stream of refrigerant gas is fed to the suction inlet of the second compressor body;
- a second compression stage for compressing the mixed refrigerant gas from the second pressure to a third pressure, the second compression stage comprising a single compressor body; and,
- a first merging means for recombining the first stream of refrigerant gas with the second stream of refrigerant gas to form a combined stream downstream of the first compression stage for delivery to the single compressor body of the second compression stage.

To remove the heat of compression from the refrigerant, the refrigerant circuit may further comprise a first intercooling heat exchanger, wherein the first intercooling heat exchanger is arranged between the first compression stage and the second compression stage. In one form, the first merging means is arranged upstream of the first intercooling heat exchanger.

In one form, the first distribution means is arranged to split the mass flow of refrigerant gas evenly between the at least two parallel compressor bodies. The size of the at least two parallel compressor bodies will depend, in part, on the flow rate of refrigerant being processed by the refrigerant circuit and the size of each compressor body. In one form, each of the at least two parallel compressor bodies is capable of compressing a suction volumetric flow rate of refrigerant gas of at least 100,000 $m^3/h$ or at least 150,000 $m^3/h$ or at least 200,000 $m^3/h$.

In one form, one or both of the first and second compression stages comprise at least two segments arranged in a single back to back compressor body.

Advantageously, in one form, the refrigerant circuit comprises a first compression string drivingly coupled to a first driver and a second compression string drivingly coupled to a second driver, and the first and second compression stages are arranged on the first and second compression string such that each of the first and second compression strings comprises no more than two compressor bodies.

In one form, the first and second drivers provide substantially even power draw to the refrigeration circuit.

Alternatively or additionally, at least one of the first and second drivers may be a gas turbine and the refrigeration circuit may further comprise a third driver in the form of a steam turbine driven by the waste heat recovered from the exhaust gas of the gas turbine.

In one form, the refrigeration circuit further comprises a third compression stage for compressing the mixed refrigerant gas from the third pressure to a fourth pressure. To remove the heat of compression from the refrigerant, the circuit may further comprise a second intercooling heat exchanger arranged between the second compression stage and the third compression stage for removing heat of compression from the refrigerant.

In one form, the second and third compression stages are combined within a single back to back compressor body.

In one form, the circuit further comprises a second distribution means for splitting the mass flow of refrigerant gas to the second stage of compression across the at least two parallel first and second compressor bodies, such that a first stream of refrigerant gas is fed to the suction inlet of the first compressor body and a second stream of refrigerant gas is fed to the suction inlet of the second compressor body, and a second merging means for recombining the first stream of refrigerant gas with the second stream of refrigerant gas downstream of the second compression stage for delivery to the third compression stage.

According to a second aspect of the present invention there is provided a plant for the production of a liquefied hydrocarbon product such as liquefied natural gas, the plant comprising:

- a main heat exchanger in which natural gas is liquefied by means of indirect heat exchange with an evaporating mixed refrigerant; and,
- a refrigerant circuit according to the first aspect of the present invention for compressing the evaporated refrigerant for re-use in the main heat exchanger system.

In one form of the plant, the first distribution means is arranged upstream of the main heat exchanger system.

According to a third aspect of the present invention there is provided a method for cooling, preferably liquefying, a hydrocarbon stream, wherein the hydrocarbon stream is cooled by indirect heat exchange with an evaporating refrigerant, and the evaporated refrigerant is cooled using a refrigerant circuit according to the first aspect of the present invention.

According to a fourth aspect of the present invention there is provided a refrigerant circuit substantially as herein described with reference to and as illustrated in the accompanying drawings.

DESCRIPTION OF THE DRAWINGS

In order to facilitate a more detailed understanding of the nature of the invention embodiments will now be described in detail, by way of example only, with reference to the accompanying drawings, in which.

DETAILED DESCRIPTION

Figure 1:
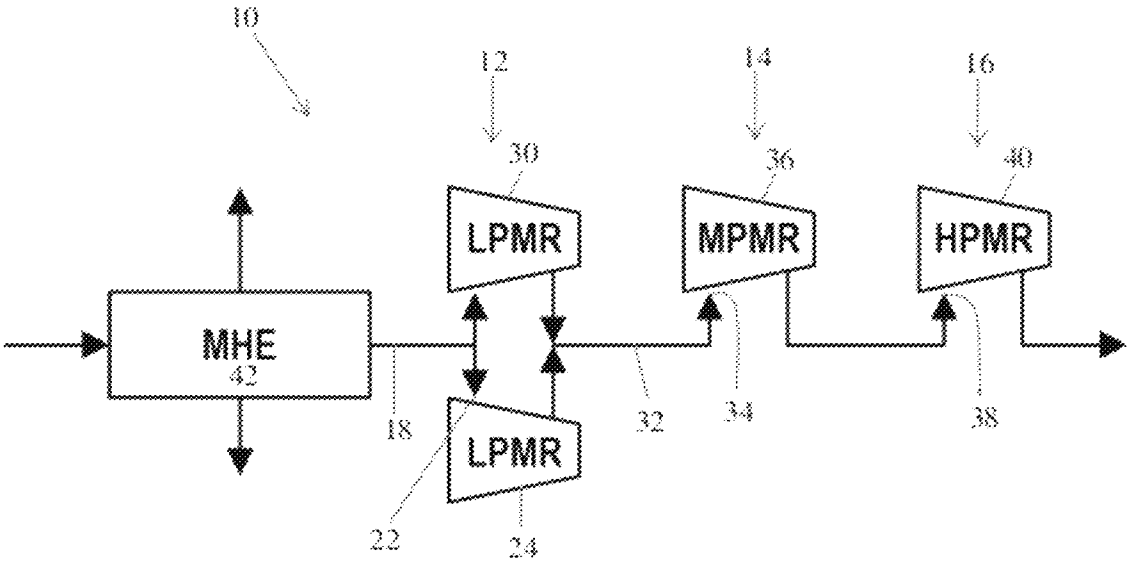
FIG. 1 is a schematic flowchart of a refrigerant compressor circuit using three mixed refrigerant compression stages in which the mass flow of refrigerant to the first compression stage is split across two separate parallel compressor bodies.

The present invention will now be described in greater detail with reference to the accompanying drawings wherein several preferred embodiments of the present invention are set forth. Those skilled in the art will recognized that the accompanying drawings are schematic representations only and therefore, many items of equipment that would be needed in a commercial plant for successful operation have been omitted for the sake of clarity. Such items might include, for example, compressor controls, flow, level, temperature and pressure controls, pumps, motors, filters, additional heat exchangers, and valves, etc. It will be readily appreciated that a person skilled in the art would be able to include such items in accordance with standard engineering practice.

The term "compressor" as used herein refers to a device used to increase the pressure of an incoming fluid by decreasing its volume.

The term "compressor body" as used herein refers to a casing which holds the pressure side of the fluid passing through a compressor. While the compressors bodies used for the LPMR stage may be centrifugal (radial) type or axial, it is preferable to use centrifugal (radial) compressor bodies for the MPMR and HPMR compression stages.

The term "compression string" is used to describe one or more compressor bodies mounted on a common shaft and driven by a common driver.

The term "driver" as used herein refers to a mechanical device such as a gas turbine, a steam turbine, an electric motor or a combination thereof which is used to cause rotation of a shaft upon which a compression string is mounted.

The term "stage" as used herein means a compressor or compressor segment having one or more impellers wherein the mass flow of the fluid being compressed in the stage is constant through the stage. For mixed refrigerant compression, each stage is optionally defined by intercooling between them.

The term "intercooling" is used to refer to a process by which heat of compression is removed from a fluid between stages.

The term "back-to-back compressor" refers to a compressor body having two compression sections within a single casing, each stage having one inlet and one outlet.

As used herein, the terms "upstream" and "downstream" shall be used to describe the relative positions of various components of a natural gas liquefaction plant along the flow path of natural gas through the plant.

Preferred embodiments of the present invention are ideally suited to LNG trains with a capacity in the range of 5.5-6.5 million tonnes per annum ("mtpa"), but can be modified to suit processing plants of other capacities.

Numerous systems exist in the prior art for the liquefaction of a hydrocarbon feed stream by heat exchange with one or more refrigerants such as propane, propylene, ethane, ethylene, methane, nitrogen or combinations of the preceding refrigerants (so-called "mixed refrigerant" systems). For example, U.S. Pat. No. 4,698,080 discloses a liquefaction plant of the so-called cascade type having three refrigeration circuits operating with different refrigerants, propane, ethylene and methane. An alternative to the cascade-type liquefaction plant is a so-called propane-pre-cooled multi-component or "mixed refrigerant" (MR) liquefaction plant. Examples of liquefaction processes using mixed refrigerants are given in U.S. Pat. No. 5,832,745, U.S. Pat. No. 6,389,844, U.S. Pat. No. 6,370,910 and U.S. Pat. No. 7,219,512 (the contents of which are hereby specifically incorporated by reference). As methods and systems for liquefying a hydrocarbon stream are well known in the art they do not form a portion of the present invention and thus the operating conditions of the refrigeration side and the compositions of the refrigerants are not discussed in detail here.

The hydrocarbon stream to be liquefied may be any suitable hydrocarbon-containing stream, such as a natural gas stream obtained from natural gas or petroleum reservoirs or natural gas from a synthetic source such as a Fischer-Tropsch process. Whilst the composition of this gas stream may vary significantly, the hydrocarbon stream is comprised substantially of methane (e.g. >60 mol % methane). Depending on the source, the hydrocarbon stream may contain varying amounts of hydrocarbons heavier than methane such as ethane, propane, butane and pentane as well as some aromatic hydrocarbons. The hydrocarbon stream may also contain undesirable non-hydrocarbon components such as $H_2O$, mercury, $CO_2$, $H_2S$, mercaptans, and other sulphur compounds. Various pre-treatment steps provide a means for removing undesirable components from the natural gas feed stream prior to liquefaction. As these pre-treatment steps are well known to the person skilled in the art, they do not form a portion of the present invention and are not further discussed here.

During normal operation a pre-treated hydrocarbon feed stream is pre-cooled using one or more pre-cooling heat exchangers before being supplied to a main cryogenic heat exchanger system (MHE) comprising one or more main heat exchangers. In the main heat exchanger system, the pre-cooled hydrocarbon feed stream is subjected to further cooling, and liquefied by means of indirect heat exchange with a refrigerant, in this example, an evaporating mixed refrigerant. When the hydrocarbon feed stream is natural gas, liquefied natural gas is removed from the discharge end of the main heat exchanger system. Specific examples of an indirect heat exchanger for use as one of the main heat exchangers include a spiral wound heat exchanger, a shell-and-tube heat exchanger, and a brazed aluminium plate-fin heat exchanger. Evaporated mixed refrigerant is removed as a gas from the main heat exchanger system and is passed to a refrigerant compressor circuit for compressing the evaporated refrigerant gas so that it can be re-used in the main heat exchanger system. The refrigerant compressor circuit consists of at least two, and preferably three, mixed refrigerant compression stages. It is contemplated that more than three stages of compression may be found to be desirable for a particular application.

Reference is now made to FIG. 1 in which a refrigerant compressor circuit (10) using three stages of mixed refrigerant compression is illustrated. For the sake of clarity the drivers and the intercooling heat exchangers are not shown in FIG. 1, but are discussed in greater detail below with reference to FIG. 2. In this embodiment, the refrigerant compressor circuit (10) comprises a first low pressure (LPMR) compression stage (12) for compressing a mixed refrigerant gas from a first pressure to a second pressure, a second medium pressure (MPMR) compression stage (14) for compressing the mixed refrigerant gas for the second pressure to a third pressure, and, a third high pressure (HPMR) compression stage (16) for compressing the mixed refrigerant gas from the third pressure to a fourth pressure.

The refrigerant circuit of the present invention differs from prior art refrigerant circuits in that the first compression stage (12) is provided with at least two separate parallel compressor bodies, each compressor body having a suction inlet and an outlet. A first distribution means (18) is used for splitting the mass flow of refrigerant gas to the first compression stage (12) across the at least two parallel compressor bodies, such that a first stream (20) of the mass flow of refrigerant gas is fed to a suction inlet (22) of a first compressor body (24) and a second stream (26) of the mass flow of refrigerant gas is fed to a suction inlet (28) of the second compressor body (30). A first merging means (32) is provided downstream of the first and second compressor bodies (24 and 30, respectively) for re-combining the first and second streams (20 and 26, respectively) after the refrigerant gas has been discharged from the first compression stage (12). The refrigerant gas is then directed to flow into a suction inlet (34) of a single compressor body (36) in the second compression stage (14). When the refrigerant circuit (10) includes a third compression stage (16), the refrigerant gas discharged from the second compression stage (14) is directed to flow into a suction inlet (38) of a single compressor body (40) of the third compression stage (16).

In the embodiment illustrated in FIG. 1, the first distribution means (18) is used to split the mass flow of refrigerant gas to the first stage of compression (12) between the first compressor body (24) and the second compressor body (30) in such a way that the mass flow rate of the first stream (20) of refrigerant fed to the suction inlet (22) of the first compressor body (24) is substantially equal to the mass flow rate of the second stream (26) of refrigerant fed to the suction inlet (28) of the second compressor body (30). It is to be understood that it is equally permissible for the first distribution means (18) to be located upstream of the main heat exchanger system (42) whereby at least two parallel streams of refrigerant are evaporated by indirect heat exchange with the hydrocarbon feed stream as it passes through the main heat exchanger system (42).

Using the refrigerant circuit illustrated in FIG. 1 reduces the total number of compressor bodies required for normal operation compared with prior art arrangements which rely on the use of parallel compressor bodies for each and all of the first, second and third compression stages. Thus, a cost reduction is achieved through the need to use fewer compressor bodies per driver or through the need to use fewer drivers.

A further advantage of the present invention is that the actual volumetric flows at the suction inlet to each compression stage are inherently more even, potentially improving the overall efficiency of the refrigerant compressor circuit. As the pressure increases through the compression stages, the density increases and the volumetric flow decreases. By virtue of the compression ratio, the second and third compression stages have lower actual volumetric flow rates than the first (low pressure) compression stage. By splitting the mass flow of refrigerant gas to the first compression stage (12) across at least two separate parallel compressor bodies, the volumetric flow in each of the first and second compressor bodies (24 and 30, respectively) is halved. By way of example, the suction volumetric flow of a first compression stage might typically be about ten times the volumetric flow at the suction inlet of a third compression stage. By splitting the mass flow of refrigerant to the first compression stage across two parallel compressor bodies, each of the first and second compressor bodies in the first compression stage would only require a suction volumetric flow five times the volumetric flow of the third compression stage. By way of further example, for an LNG train producing about 6 mtpa, the suction flow inlet size for a single compressor body used for the first compression stage would need to be about 300,000 $m^3/h$, which is greater than the largest commercially available compressor on the market at this time. Using the process of the present invention, the mass flow of refrigerant to the first stage of compression (12) is split across at least two parallel compressor bodies (24 and 30, respectively), with each of the first and second compressor bodies being capable of compressing about 150,000 $m^3/h$.

The efficiency of each compression stage is dependent upon the rotational speed of the shaft. Usually the optimum compressor stage efficiency is achieved with a higher rotational speed for a smaller suction volumetric flow compared to a larger suction volume. As multiple compressor bodies are often mounted on a common shaft, the overall optimum rotational speed for a given compression string may be a compromise between the ideal speed for each compressor body arranged on that compression string. By having more even suction volumetric flows, multiple compressor bodies may be mounted on the same shaft and operated closer to their optimum speed. Thus the compressor stage efficiencies may be improved when matched with a suitable driver. This leads to lower energy consumption or more production for the same energy input.

Figure 2:
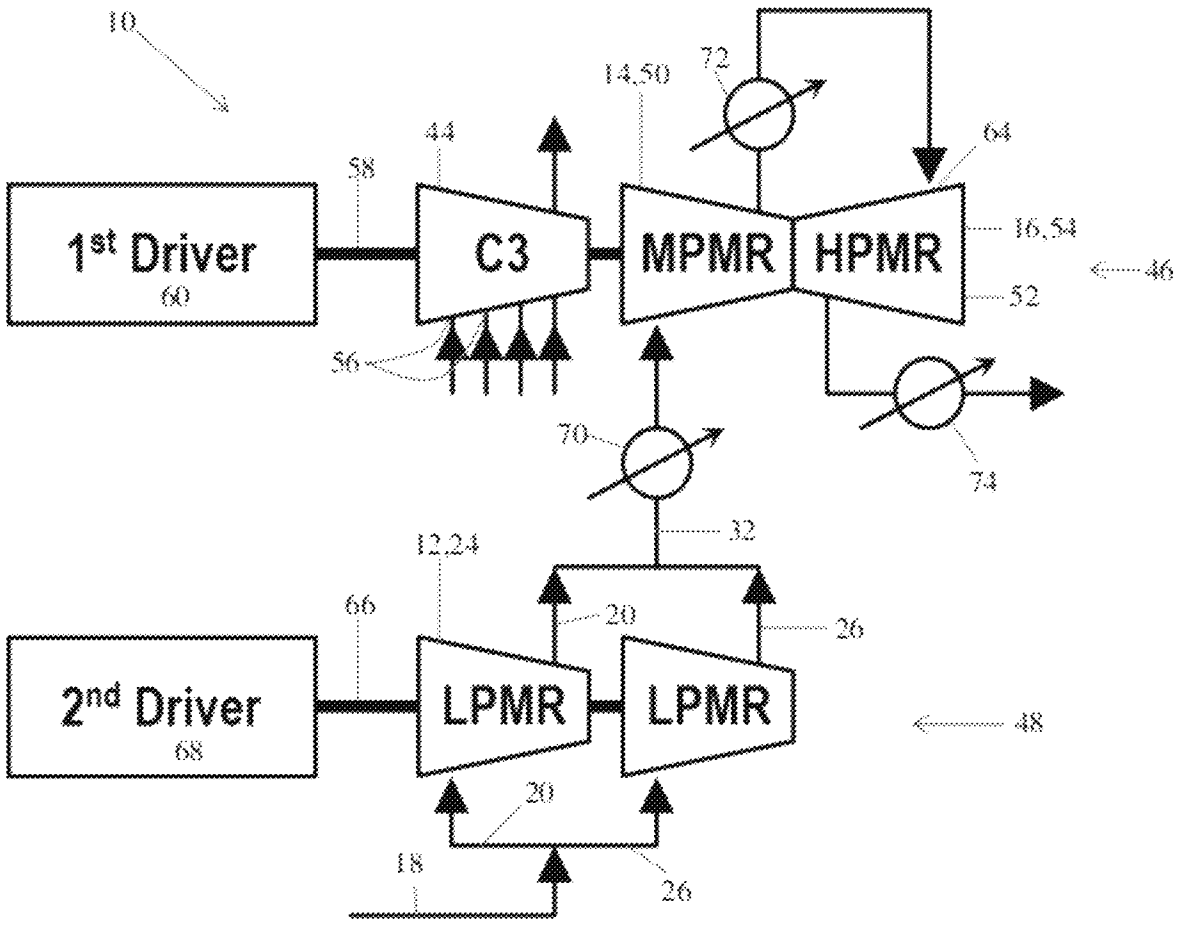
FIG. 2 is a schematic flowchart of an alternative embodiment of a refrigerant compressor circuit with three mixed refrigerant compression stages, plus an additional compressor body servicing a separate pre-cooling refrigerant circuit, arranged on two compression strings showing intercooling between each mixed refrigerant compression stage.

In the arrangement illustrated in FIG. 2, for which like reference numerals refer to like parts, the refrigerant compression circuit (10) includes a single pre-cooling refrigerant compressor body (44) and three stages of mixed refrigerant compression (12, 14, and 16, respectively) arranged on a first compression string (46) and a second compression string (48) with intercooling between each stage. In this embodiment, the second and third compression stages (14 and 16, respectively) are combined as a first segment (50) and a second segment (52) within a single back-to-back compressor body (54).

Downstream of the last compression stage (14 or 16), the mixed refrigerant is supplied to one or more heat exchangers where the mixed refrigerant is progressively cooled and at least partially liquefied, before being recycled to the main heat exchanger. At least a portion of the cooling of the mixed refrigerant upstream of the main heat exchanger system may be via indirect heat exchange with the pre-cooling refrigerant in one or more pre-cooling heat exchangers (not shown). The pre-cooling refrigerant compressor body (44) may compress pre-cooling refrigerant evaporated by the cooling of the mixed refrigerant. Alternatively or additionally, it may be used to compress pre-cooling refrigerant evaporated in one or more of the pre-cooling heat exchangers used for the purpose of pre-cooling the hydrocarbon feed stream before it enters the main heat exchanger system (42), or for other purposes such as the fractionation of NGLs removed from the natural gas. Thus, the refrigerant being compressed using the pre-cooling refrigerant compressor body (44) could be a substantially pure refrigerant such as propane or ammonia, or alternatively a separate mixed refrigerant with a different composition to the mixed refrigerant evaporated in the main heat exchanger system.

Pre-cooling refrigerant streams evaporated by various heat exchangers at similar pressures are combined and collected using gas liquid/separators such that the pre-cooling refrigerant compressor body (44) is used to compress the combined vapour flows at a plurality of different pressures. The pre-cooling refrigerant compressor body (44) illustrated in FIG. 2 is shown with four suction inlets (56) arranged to receive evaporated pre-cooling refrigerant at four different pressures. It is to be understood that pre-cooling refrigerant compressor body (44) may equally be provided with any number of suction inlets (56).

The arrangement illustrated in FIG. 2 offers in excess of 6 mtpa of LNG liquefaction capacity in a single train, with only two compression strings per train, and no more than two compressor bodies per string. The single pre-cooling refrigerant compressor body (44) is mounted on a first shaft (58) drivingly coupled to a first driver (60) in a first compression string (46). The first compression string (46) also includes the second and third compression stages (14 and 16, respectively) combined in a single back to back compressor body (54) with the outlet (62) of the second compression stage (14) being connected to the suction inlet (64) of the third compression stage (16).

The first compressor body (24) and the second compressor body (30) of the first compression stage of compression (12) are mounted co-axially on a second shaft (66) and operated by a second driver (68) in a second compression string (48). The first distribution means (18) is used for splitting the mass flow of mixed refrigerant gas to the first stage of compression (12) substantially evenly across the first compressor body (24) and the second compressor body (30) in an analogous manner to that described above for the refrigerant circuit of FIG. 1. The first merging means (32) combines the first and second streams (20 and 26, respectively) of the mass flow of refrigerant discharged from first and second compressor bodies (24 and 30, respectively) for delivery to the second stage of compression (14).

A first intercooling heat exchanger (70) is arranged between the first compression stage (12) and the second compression stage (14) for removing heat of compression from the mixed refrigerant gas. The first merging means (32) for combining the first and second streams (20 and 26, respectively) of the mass flow of refrigerant discharged from the first stage of compression (12) can be either upstream or downstream of the first intercooling heat exchanger (70). When three stages of compression are used, a second intercooling heat exchanger (72) can be provided between the second and third compression stages (14 and 16, respectively) to remove the heat of compression from the mixed refrigerant between the second and third compression stages. A third intercooling heat exchanger (74) can be provided downstream of the third compression stage (16) to remove the heat of compression from the refrigerant after the third compression stage. In the intercooling heat exchangers (70, 72 and 74) the compressed mixed refrigerant exchanges heat with a cooling means, by way of example, an ambient cooling fluid, such as water or air.

Figure 3:
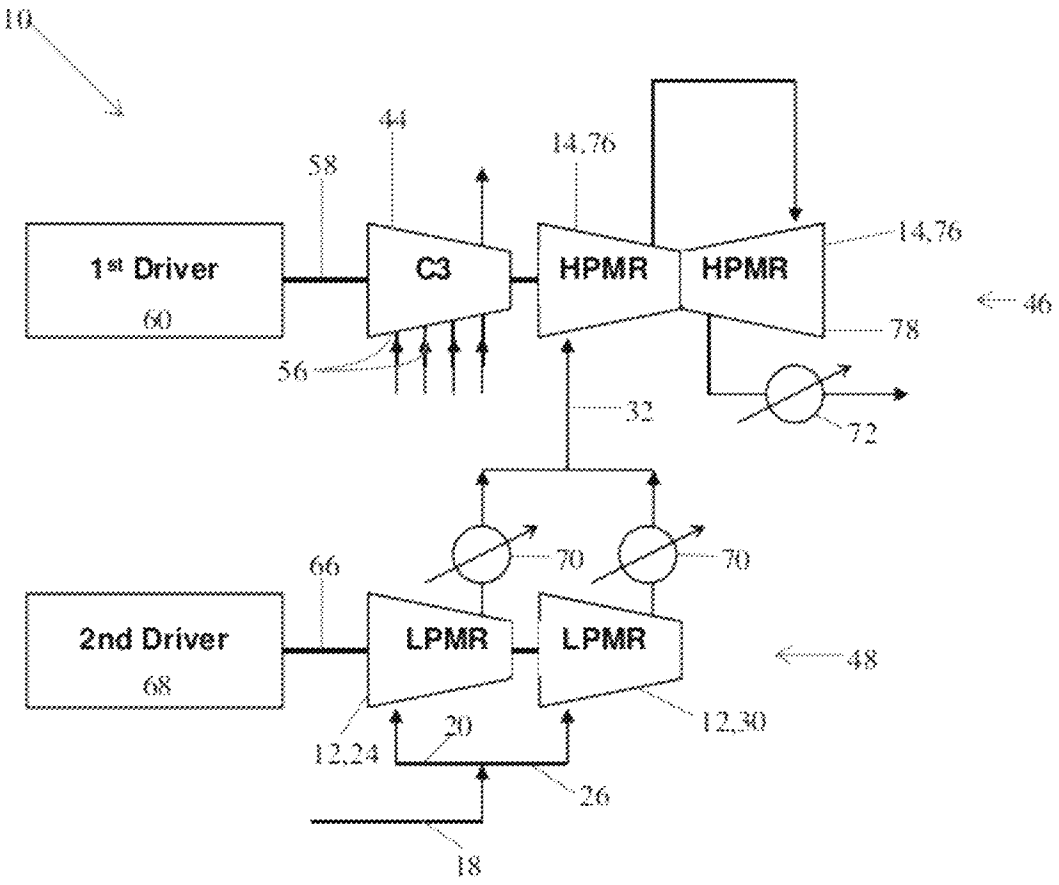
FIG. 3 is a schematic flowchart of an alternative embodiment of a refrigerant compressor circuit with two mixed refrigerant compression stages, plus an additional compressor body servicing a separate pre-cooling refrigerant circuit, arranged on two compression strings showing merging of the first and second streams from the outlet of the first compression stage occurring downstream of the first intercooling heat exchanger.

In FIG. 3, for which like reference numerals refer to like parts, an alternative arrangement of the refrigerant circuit (10) to that of FIG. 2 is illustrated with only two compression stages. In this arrangement, the mass flow of mixed refrigerant to the first compression stage (12) is split between the first and second parallel compressor bodies (24 and 30, respectively) using the first distribution means (18) in an analogous manner to that described above in relation to FIG. 2. The first merging means (32) is then used to combine the first and second streams (20 and 26, respectively) of the refrigerant discharged from the first and second compressor bodies (24 and 30, respectively) for delivery to the second compression stage (14). In this embodiment, the second compression stage (14) is achieved in two back to back segments (76) of a single compressor body (78). In this embodiment, each of the first and second streams (20 and 26, respectively) is directed to flow through two separate first intercooling heat exchangers (70) for cooling, with the first merging means (32) being arranged downstream of the two separate first intercooling heat exchangers (70). The arrangement illustrated in FIG. 3 offers in excess of 6 mtpa of LNG liquefaction capacity in a single train, with only two compression strings per train, and no more than two compressor bodies per string.

Figure 4:
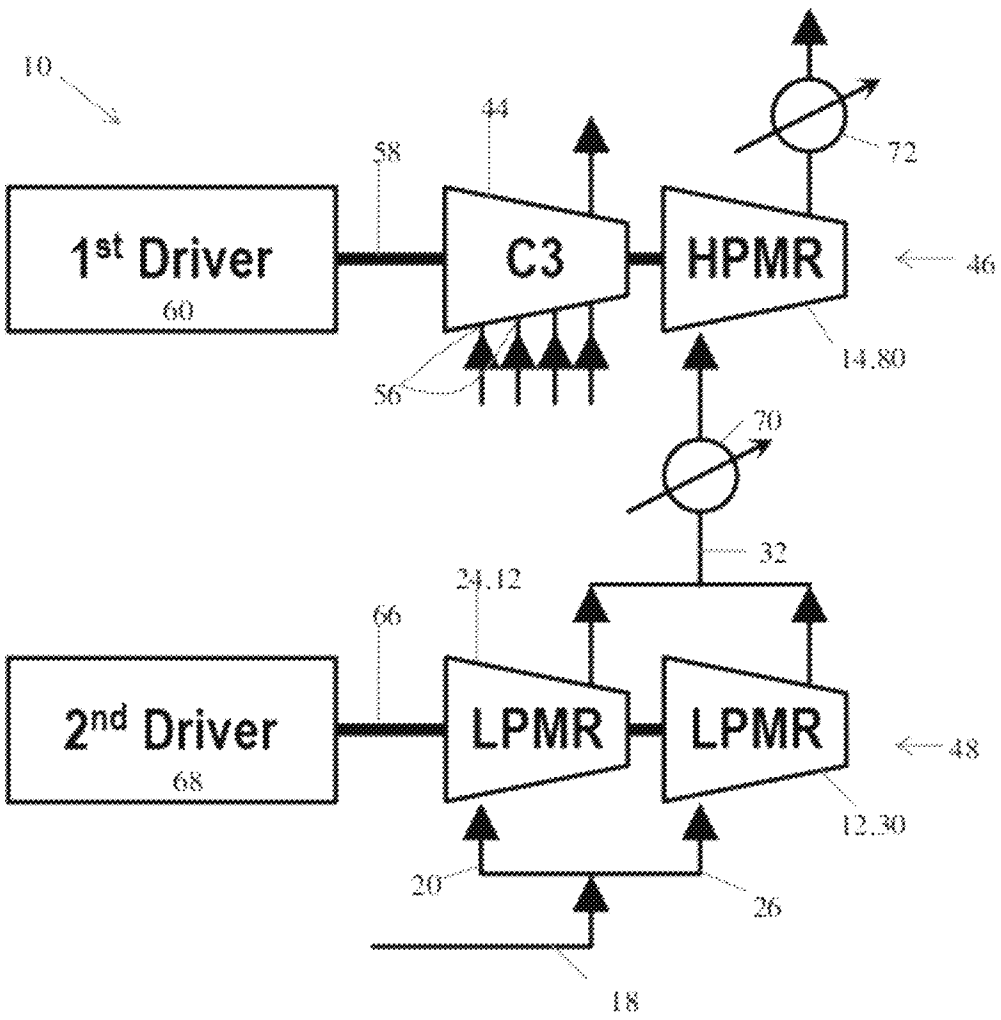
FIG. 4 is a schematic flowchart of an alternative arrangement for a refrigerant compressor circuit with two mixed refrigerant compression stages, plus an additional compressor body servicing a separate pre-cooling refrigerant circuit, arranged on two compression strings showing intercooling between each stage of refrigerant compression.

In FIG. 4, for which like reference numerals refer to like parts, an alternative arrangement for a refrigerant circuit with only two stages of mixed refrigerant compression arranged on two compression strings with intercooling between the first compression stage (12) and the second compression stage (14). In this embodiment, the flow of refrigerant is split between the first and second compressor bodies (24 and 30, respectively) in an analogous manner to that described above in relation to FIG. 2. The first and second streams (20 and 26, respectively) of the refrigerant discharged from the first and second compressor bodies (24 and 30, respectively) are combined using the first merging means (32) before being directed to flow through the first intercooling heat exchanger (70). The combined stream is then directed to single compressor body (80) for the second stage of compression (14). It is equally possible for the first and second streams (20 and 26, respectively) to be directed to separate first intercooling heat exchangers (70) for cooling, with the first merging means (32) being arranged downstream of the separate first intercooling heat exchangers (16). The arrangement illustrated in FIG. 4 offers in excess of 6 mtpa of LNG liquefaction capacity in a single train, with only two compression strings per train, and no more than two compressor bodies per string.

Figure 5:
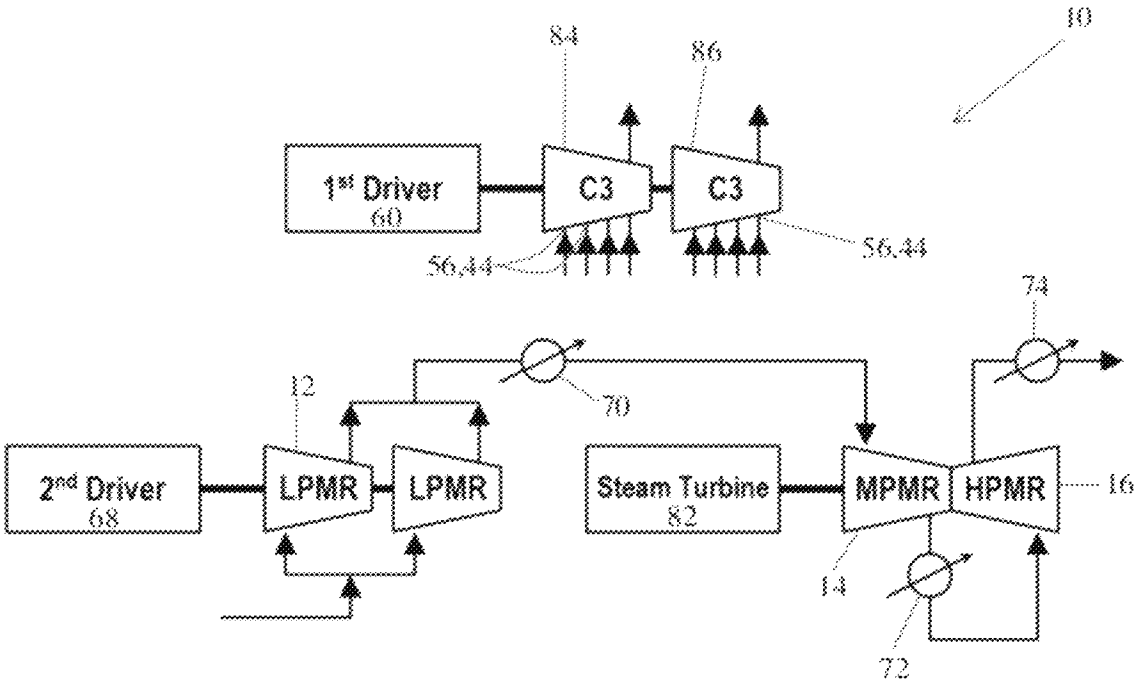
FIG. 5 is a schematic flowchart of a refrigerant compression circuit with three mixed refrigerant compressor stages, plus two additional compressor bodies servicing a separate pre-cooling refrigerant circuit, arranged on three compression strings where two gas turbines are used as the first and second drivers, supplemented with a third driver in the form of a steam turbine driven by the waste heat recovered from the exhaust gases of one or both of the gas turbines.

In FIG. 5, for which like reference numerals refer to like parts, a production rate of 6 mtpa can be achieved using two identical gas turbines as the first and second drivers (60 and 68, respectively), supplemented with a third driver (82) in the form of a steam turbine driven by waste heat recovered from the exhaust gases of one or both of the gas turbines. This arrangement may reduce fuel gas consumption as well as reduce $CO_2$ emissions. In this arrangement, the pre-cooling refrigerant compression stage (44) is shown split between two compressor bodies (84 and 86), although a single compressor body could equally be used, depending on the performance limits of each of the pre-cooling refrigerant compressors when operated using a gas turbine as the first and second drivers (60 and 68, respectively).

Figure 6:
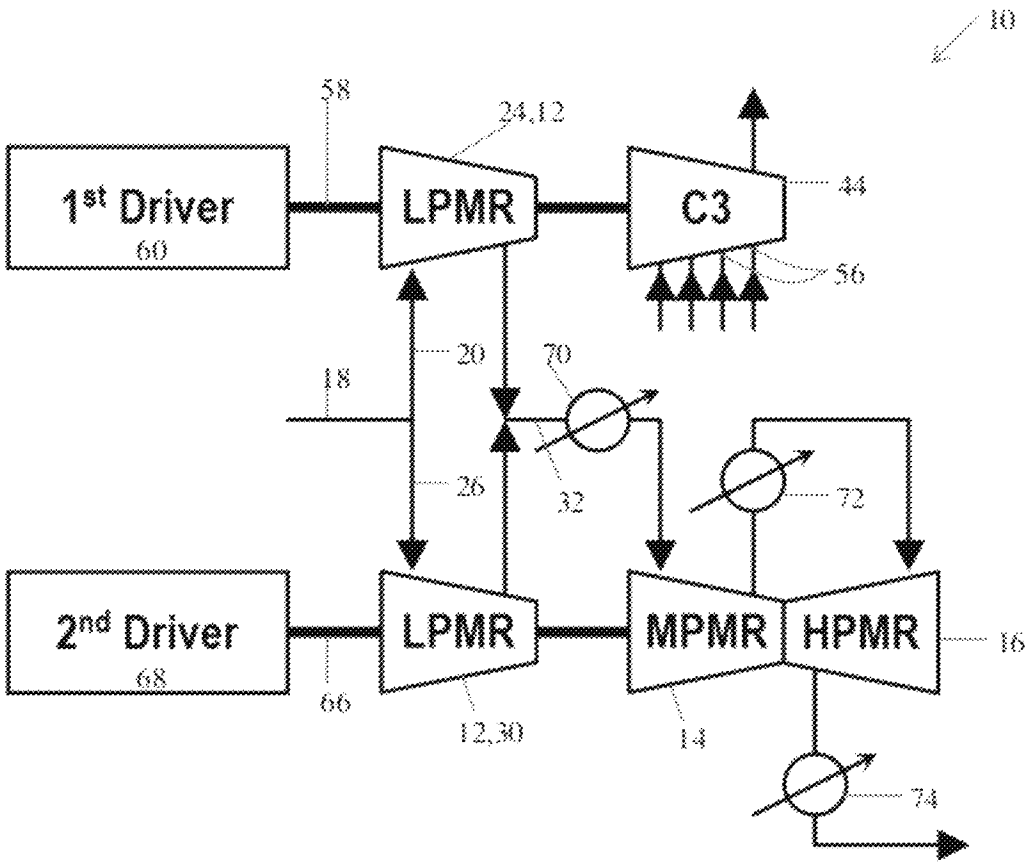
FIG. 6 is a schematic flowchart of a refrigerant compression circuit with three mixed refrigerant compressor stages, plus an additional compressor body servicing a separate pre-cooling refrigerant circuit, arranged on two compression strings specifically tailored towards the use of two drivers drawing substantially even power.

A further embodiment is illustrated in FIG. 6, for which like reference numerals refer to like parts. This embodiment is specifically tailored towards the use of first and second drivers (60 and 68, respectively) having substantially even power. Advantage is still taken of splitting the refrigerant flow to the first compression stage (12) across the at least two parallel first and second compressor bodies (24 and 30, respectively) to improve efficiency. Splitting refrigerant flow in this way has the result that the actual volumetric flow to each of the first, second and (optional) third compression stages is more consistent, allowing better matching with the ideal rotational speed when mounted on the same shaft. Also, using this arrangement in the absence of a restriction on the suction volumetric flow to the first compression stage, the LNG train size can be increased or the refrigerant circuit can be operated at a lower pressure, thereby possibly allowing greater efficiency.

Figure 7:
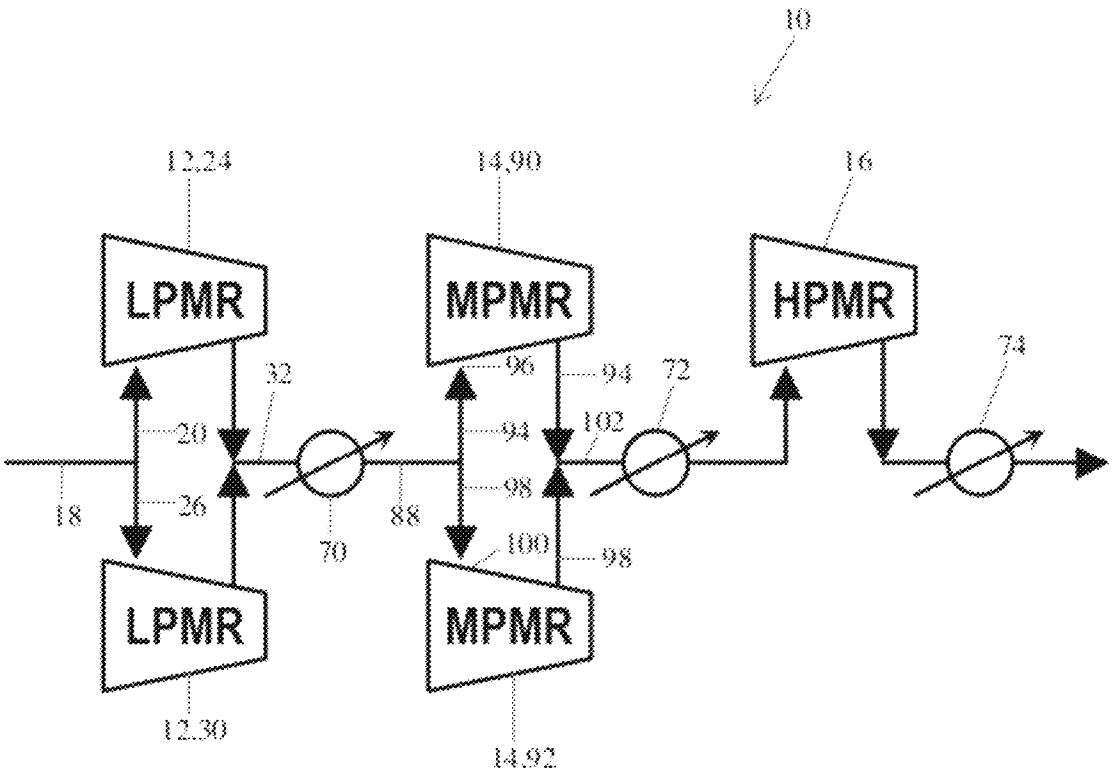
FIG. 7 is a schematic flowchart of a refrigerant compression circuit with three mixed refrigerant compressor stages in which the mass flow of refrigerant to each of the first and second compression stages is split across two separate parallel compressor bodies.

A further embodiment is illustrated in FIG. 7, for which like reference numerals refer to like parts. In this embodiment, the flow of refrigerant is split between the first and second compressor bodies (24 and 30, respectively) using the first distribution means (18) in an analogous manner to that described above in relation to FIG. 2. The first and second streams (20 and 26, respectively) of the refrigerant discharged from the first and second compressor bodies (24 and 30, respectively) are combined using the first merging means (32) before being directed to flow through the first intercooling heat exchanger (70). The combined stream is then directed to the second compression stage (14). In this embodiment, a second distribution means (88) is used to split the mass flow of refrigerant gas to the second compression stage (14) between the first and second compressor bodies (90 and 92, respectively) in such a way that the mass flow rate of a first stream (94) of refrigerant fed to the suction inlet (96) of the first compressor body (90) is substantially equal to the mass flow rate of the second stream (98) of refrigerant fed to the suction inlet (100) of the second compressor body (92). The first and second streams (94 and 98, respectively) of the refrigerant discharged from the first and second compressor bodies (90 and 92, respectively) of the second compression stage (14) are combined using a second merging means (102) before being directed to flow through the second intercooling heat exchanger (72).

Figure 8:
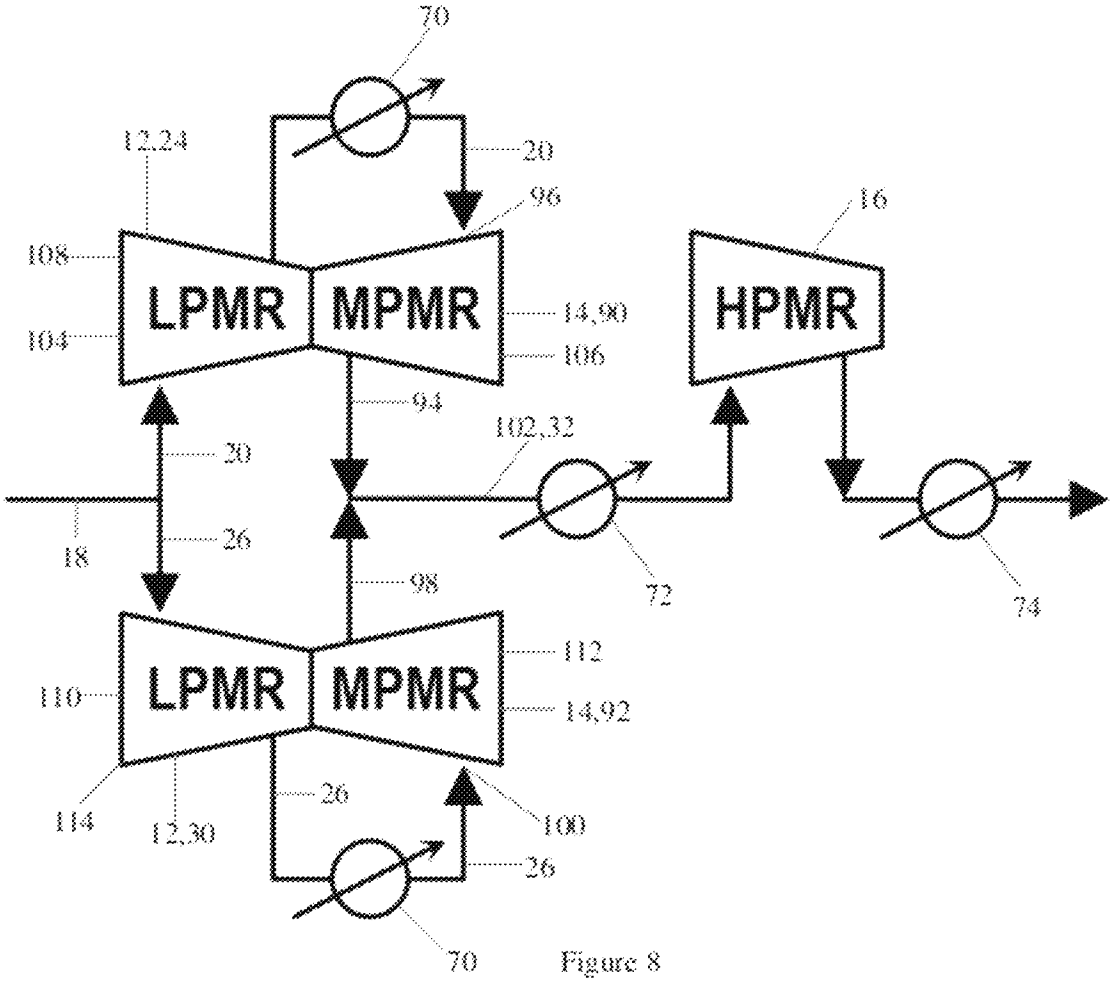
FIG. 8 is a schematic flowchart of a refrigerant compression circuit with three mixed refrigerant compressor stages specifically tailored towards the use of back-to-back compressor bodies when the mass flow of refrigerant to each of the first and second compression stages is split across two separate compressor bodies; and, FIG. 9 is a schematic flowchart of the refrigerant compression circuit of FIG. 8 showing merging of the first and second streams from the outlet of the second compression stage occurring downstream of the second intercooling heat exchangers.

A further embodiment is illustrated in FIG. 8, for which like reference numerals refer to like parts. In this embodiment, the flow of refrigerant to the first compression stage (12) is split between the first and second compressor bodies (24 and 30, respectively) using the first distribution means (18) in an analogous manner to that described above in relation to FIG. 2. However, in this embodiment, the first and second streams (20 and 26, respectively) of the refrigerant discharged from the first and second compressor bodies (24 and 30, respectively) are not combined before being directed to flow through separate first intercooling heat exchangers (70). Instead, the first stream 20 discharged from the first compressor body 24 is directed to flow through a first intercooling heat exchanger (70) before being directed to flow into the suction inlet (96) of the first compressor body (90) of the second compression stage (14). Similarly, the second stream (26) discharged from the second compressor body (30) is directed to flow through a separate first intercooling heat exchanger (70) before being directed to flow into the suction inlet (100) of the second compressor body (92) of the second compression stage (14). The first and second streams (94 and 98, respectively) of the refrigerant discharged from the first and second compressor bodies (90 and 92, respectively) are combined using the second merging means (102) before being directed to flow through the second intercooling heat exchanger (72). In this way, the flow of refrigerant to the second compression stage (14) is still being split between the first and second compressor bodies (90 and 92, respectively) however, the second merging means (102) performs the function of the first merging means (32) and the third compression stage (16) can be considered to be equivalent to a second compression stage (14) if the LPMR and MPMR stages are considered to be a first compression stage (12).

In this embodiment, the first compressor body (24) of the first compression stage (12) and the first compressor body (90) of the second compression stage (14) are combined as a first segment (104) and a second segment (106) within a back-to-back compressor body (108). The second compressor body (30) of the first compression stage (12) and the second compressor body (92) of the second compression stage (14) are combined as a first segment (110) and a second segment (112) within a separate back-to-back compressor body (114).

Figure 9:
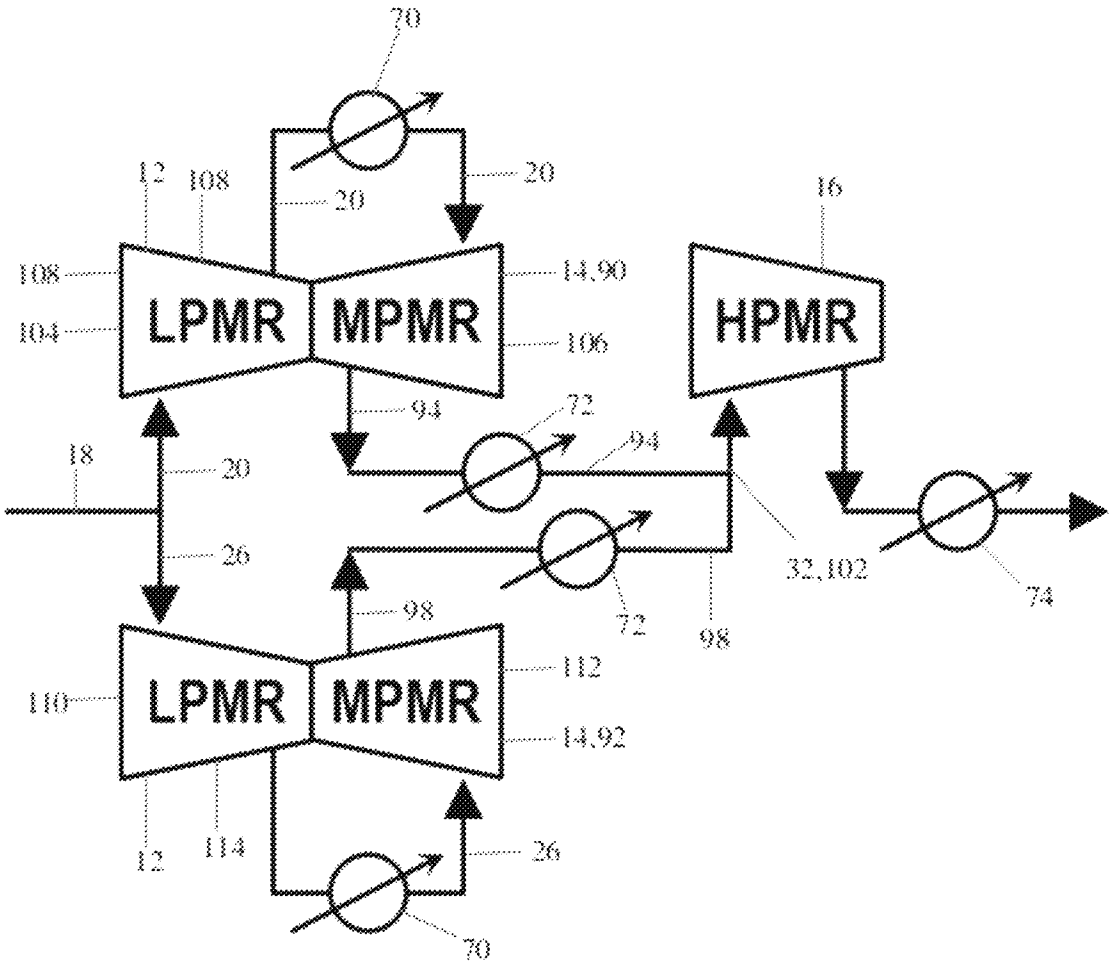

A further embodiment is illustrated in FIG. 9, for which like reference numerals refer to like parts. In this embodiment, the flow of refrigerant to each of the first and second compression stages (12 and 14, respectively) is split using back-to-back compressor bodies (108 and 114) in an analogous manner to that described above in relation to FIG. 8. In this embodiment, each of the first and second streams (94 and 98, respectively) is directed to flow through two separate second intercooling heat exchangers (72) for cooling, with the second merging means (102) being arranged downstream of the two separate second intercooling heat exchangers (72). Essentially, in this embodiment, the second merging means (102) is performing the function of the first merging means (32) as described above in relation to FIG. 8.

In each of the illustrated embodiments, the first and second drivers (60 and 68, respectively) need not provide substantially even power draw. Furthermore, in order to maintain the ideal power balance between the first and second shafts (58 and 66, respectively), the first and second streams (20 and 26, respectively) of refrigerant flow to the first and second compressor bodies of the first compression stage (12) may not be identical in that the flow split between the first and second compressor bodies (26 and 30, respectively) may be other than 50%-50%.

It will be apparent to persons skilled in the relevant art that numerous variations and modifications can be made without departing from the basic inventive concepts. All such modifications and variations are considered to be within the scope of the present invention, the nature of which is to be determined from the foregoing description and the appended claims.

What is claimed:

1. A refrigerant circuit for use in a liquefaction plant, the refrigerant circuit comprising:

a first compression stage for compressing an evaporated mixed refrigerant gas from a first pressure to a second pressure, wherein the mass flow of the mixed refrigerant gas being compressed in the first compression stage is constant through the first compression stage, and the first compression stage comprises at least a first compressor body including a first compressor body casing for the evaporated mixed refrigerant gas passing the first compressor body casing, and a second parallel compressor body including a second compressor body casing for the evaporated mixed refrigerant gas passing the second compressor body casing, the first compressor body casing is separate from the second compressor body casing, and each of the first and second compressor bodies includes a suction inlet and an outlet;

a first distribution means for splitting the mass flow of refrigerant gas to the first stage of compression evenly across the suction inlet of the first compressor body and the suction inlet of the second compressor body, such that a first stream of refrigerant gas is fed to the suction inlet of the first compressor body and a second stream of refrigerant gas is fed to the suction inlet of the second compressor body;

a second compression stage for compressing the mixed refrigerant gas from the second pressure to a third pressure, wherein the mass flow of the mixed refrigerant gas being compressed in the second compression stage is constant through the second compression stage, the second compression stage comprising a single compressor body including a single compressor body casing for the evaporated mixed refrigerant gas passing through the single compressor body, and a pre-cooling compressor for compressing a refrigerant different to the evaporated mixed refrigerant, and wherein the single compressor body casing of the second compression stage is separate from the first compressor body casing of the first compression stage and the single compressor body casing of the second compression stage is separate from the second compressor body casing of the first compression stage; and a first merging means for recombining the first stream of refrigerant gas with the second stream of refrigerant gas to form a combined stream downstream of the first compression stage for delivery to the single compressor body of the second compression stage;

wherein:

the compressor bodies of the first stage are mounted on a first common shaft driven by a first drive; and the pre-cooling compressor and at least one of the compressor bodies of the second stage are mounted on a second common shaft driven by a second drive.

2. The refrigerant circuit of claim 1, further comprising a first intercooling heat exchanger for removing heat of compression from the refrigerant, wherein the first intercooling heat exchanger is arranged between the first compression stage and the second compression stage.

3. The refrigerant circuit of claim 2, wherein the first merging means is arranged upstream of the first intercooling heat exchanger.

4. The refrigerant circuit of claim 1, wherein the mass flow rate of the first stream of refrigerant fed to the suction inlet of the first compressor body is equal to the mass flow rate of the second stream of refrigerant fed to the suction inlet of the second compressor body.

5. The refrigerant circuit of claim 1, wherein each of the at least two parallel compressor bodies is capable of compressing a suction volumetric flow rate of refrigerant gas of at least 100,000 $m^3/h$ or at least 150,000 $m^3/h$ or at least 200,000 $m^3/h$.

6. The refrigerant circuit of claim 1, further comprising a third compression stage for compressing the mixed refrigerant gas from the third pressure to a fourth pressure, wherein the mass flow of the mixed refrigerant gas being compressed in the third compression stage is constant through the third compression stage.

7. The refrigerant circuit of claim 6, further comprising a second intercooling heat exchanger arranged between the second compression stage and the third compression stage for removing heat of compression from the refrigerant.

8. The refrigerant circuit of claim 6, wherein the second and third compression stages are combined within a single back to back compressor body.

9. A plant for the production of a liquefied hydrocarbon product such as liquefied natural gas, the plant comprising:

a main heat exchanger in which natural gas is liquefied by indirect heat exchange with an evaporating mixed refrigerant; and the refrigerant circuit of claim 1 for compressing the evaporated refrigerant for re-use in the main heat exchanger system.

10. The plant for the production of a liquefied hydrocarbon product of claim 9, wherein the first distribution means is arranged upstream of the main heat exchanger system.

11. A method for cooling or liquefying a hydrocarbon stream, wherein the hydrocarbon stream to be cooled by indirect heat exchange with an evaporating refrigerant, and the evaporated refrigerant is cooled using a refrigerant circuit, the method comprising:

compressing an evaporated mixed refrigerant gas from a first pressure to a second pressure in a first compression stage, wherein the mass flow of the mixed refrigerant gas being compressed in the first compression stage is constant through the first compression stage, and the first compression stage comprises at least a first compressor body including a first compressor body casing for the evaporated mixed refrigerant gas passing the first compressor body casing, and a second parallel compressor body including a second compressor body casing for the evaporated mixed refrigerant gas passing the second compressor body casing, the first compressor body casing is separate from the second compressor body casing, and each of the first and second compressor bodies includes a suction inlet and an outlet;

splitting the mass flow of refrigerant gas to the first stage of compression evenly across the first and second compressor bodies, such that a first stream of refrigerant gas is fed to the suction inlet of the first compressor body and a second stream of refrigerant gas is fed to the suction inlet of the second compressor body;

compressing the mixed refrigerant gas from the second pressure to a third pressure in a second compression stage, wherein the mass flow of the mixed refrigerant gas being compressed in the second compression stage is constant through the second compression stage, the second compression stage comprising a single compressor body including a single compressor body casing for the evaporated mixed refrigerant gas passing through the single compressor body, and wherein the single compressor body casing of the second compression stage is separate from the first compressor body casing of the first compression stage and the single compressor body casing of the second compression stage is separate from the second compressor body casing of the first compression stage;

recombining the first stream of refrigerant gas with the second stream of refrigerant gas to form a combined stream downstream of the first compression stage for delivery to the single compressor body of the second compression stage;

driving the compressor bodies of the first stage on a first common shaft driven by the same drive:

using a pre-cooling compressor to compress a refrigerant which is different to the evaporated mixed refrigerant; and driving the pre-cooling compressor and at least one of the compressor bodies of the second stage are mounted on a second common shaft driven by a second drive.

12. The method of claim 11, further comprising:

removing heat of compression from the refrigerant in a first intercooling heat exchanger, wherein the first intercooling heat exchanger is arranged between the first compression stage and the second compression stage.

13. The method of claim 12, wherein the first merging means is arranged upstream of the first intercooling heat exchanger.

14. The method of claim 11, wherein the mass flow rate of the first stream of refrigerant fed to the suction inlet of the first compressor body is equal to the mass flow rate of the second stream of refrigerant fed to the suction inlet of the second compressor body.

15. The method of claim 11, wherein each of the at least two parallel compressor bodies is arranged to receive a suction volumetric flow rate of refrigerant gas of at least 100,000 $m^3/h$ or at least 150,000 $m^3/h$ or at least 200,000 $m^3/h$.

16. The method of claim 11 further comprising:

compressing the mixed refrigerant gas from the third pressure to a fourth pressure in a third compression stage, wherein the mass flow of the mixed refrigerant gas being compressed in the third compression stage is constant through the third compression stage.

17. The method of claim 16, further comprising:

removing heat of compression from the refrigerant in a second intercooling heat exchanger arranged between the second compression stage and the third compression stage.

18. The method of claim 16, wherein the second and third compression stages are combined within a single back to back compressor body.

* * * * *